US008142299B1

(12) United States Patent
Shah

(10) Patent No.: US 8,142,299 B1
(45) Date of Patent: Mar. 27, 2012

(54) TRAINING AID

(76) Inventor: Sarmad Shah, Louisville, KY (US)

( * ) Notice: Subject to any disclaimer, the term of this patent is extended or adjusted under 35 U.S.C. 154(b) by 0 days.

(21) Appl. No.: 13/013,480

(22) Filed: Jan. 25, 2011

(51) Int. Cl.
*A63B 69/36* (2006.01)

(52) U.S. Cl. ..... 473/213; 473/205; 473/212

(58) Field of Classification Search ..... 473/201, 473/205, 206, 212, 213, 450, 458, 464
See application file for complete search history.

(56) References Cited

U.S. PATENT DOCUMENTS

| | | | | |
|---|---|---|---|---|
| 2,831,196 | A | 4/1958 | Scheiber | |
| 4,222,569 | A | 9/1980 | DeMascolo | |
| 4,257,607 | A | 3/1981 | Nedwick | |
| 5,152,532 | A | 10/1992 | Rouse | |
| 5,156,399 | A * | 10/1992 | Gauer | 473/205 |
| 5,230,513 | A * | 7/1993 | Rouse | 473/205 |
| 5,309,573 | A | 5/1994 | Solar et al. | |
| 5,823,980 | A | 10/1998 | Kopfer | |

FOREIGN PATENT DOCUMENTS

| | | |
|---|---|---|
| JP | 10-118237 | 5/1998 |

* cited by examiner

*Primary Examiner* — Nini Legesse
(74) *Attorney, Agent, or Firm* — Middleton Reutlinger; James E. Cole

(57) ABSTRACT

A wrist guide for athletic training comprises a first wrist structure extending along a user's wrist, the first wrist structure having a first end and a second end, the first wrist structure having an inner surface and an outer surface, a curved element having a first end connected to the first wrist structure and a second end connected to a second wrist structure, the second wrist structure extending from the curved element above the first wrist structure, a visual aid receiver on an upper surface of the second wrist structure, the receiver having a first portion for receiving a visual aid and a second portion in communication with the first portion for movement of the visual aid, the visual aid positioned in the receiver and being positionable in at least one of a first orientation wherein the visual aid is substantially perpendicular to an outer surface of the second wrist structure and a second orientation wherein the visual aid is substantially parallel to the outer surface of the second wrist brace structure.

18 Claims, 10 Drawing Sheets

TRAINING AID

CROSS-REFERENCE TO RELATED DOCUMENTS

None.

TECHNICAL FIELD

This present invention pertains to a training aid. More specifically, the present invention pertains to a training aid having a movable visual aid which may be moved between first and second orientations and at least first and second positions in at least one of the orientations.

BACKGROUND

Hand position, and more specifically the dorsal hand surface of the left hand for a right handed golfer, is related to the club face position of a golf club. Thus, position of the dorsal hand surface is related to proper club face, assuming a proper grip.

Many golf instructors advise that when learning proper golf swing hand positions provide usable milestones where a player can check positions to determine if the swing practice is accurate or not. Similarly, many professional golfers are seen practicing and reviewing hand positions including various positions of the backswing and the impact position both during practice sessions and between shots during rounds of play.

Further, various golf instructors now utilize video instruction wherein a golfer's hand positions may be seen and linear elements to the video may be added by way of computer aided video editing techniques in order to provide visual indications of hand positions among other things. However, these techniques are not instantaneous. Instead, a video camera must be set up and then the video edited in order to show a user various positions and views of the golf swing. This additionally likely requires at least one additional person to shoot the video accurately and in a time effective manner. In other words, these methods do not provide instantaneous feedback.

It would be preferable to provide a device which overcomes these and other deficiencies. It would further be desirable to provide a device which may be used by a golfer and may provide instant feedback during a golf swing. Also, it would be desirable to provide a device which allows various types of feedback to a user and may be used to provide feedback about various positions during a golf swing or a swing of a baseball bat for example, in order to provide a visual aid in teaching a proper swing as part of athletic training.

SUMMARY

A wrist guide for athletic training comprises a first wrist structure extending along a user's wrist, the first wrist structure having a first end and a second end, the first wrist structure having an inner surface and an outer surface, a curved element having a first end connected to the first wrist structure and a second end connected to a second wrist structure, the second wrist structure extending from the curved element above the first wrist structure, a visual aid receiver on an upper surface of the second wrist structure, the receiver having a first portion for receiving a visual aid and a second portion in communication with the first portion for movement of the visual aid, the visual aid positioned in the receiver and being positionable in at least one of a first orientation wherein the visual aid is substantially perpendicular to an outer surface of the second wrist structure and a second orientation wherein the visual aid is substantially parallel to the outer surface of the second wrist brace structure. The wrist guide wherein the first wrist structure and the second wrist structure are parallel. The wrist guide wherein the wrist guide is substantially U-shaped. The wrist guide wherein the visual aid is slidable from a first location to a second location. The wrist guide wherein the receiver has a first position having a first radius and a second position having a second radius. The wrist guide further comprising a lip extending about the receiver at the second position. The wrist guide wherein the visual aid has a first button for orienting the visual aid in the first orientation and a second button for orienting the visual aid in the second orientation. The wrist guide further comprising a plurality of dimples on an outer surface of the first wrist structure.

A wrist guide comprises a clip defined by a first wrist guide structure and a second wrist guide structure, a connecting segment which is curvilinear and extending between the first wrist guide structure and the second wrist guide structure, the clip being shaped to fit between a user's hand and a golf glove, an outer surface of said clip having a receiver, said receiver having a visual aid therein, the receiver including a first position for removal of the visual aid and a second position for retaining the visual aid, the visual aid having at least one mating structure which is received by the receiver and movable from the first position to the second position, the at least one mating structure allowing the visual aid to be positioned in one of a first orientation and a second orientation, the first orientation being one of substantially parallel or substantially perpendicular to the second wrist guide structure. The wrist guide wherein the at least one mating structure is a grommet. The wrist guide wherein the grommet has a channel. The wrist guide wherein a lip extends about a portion of the receiver. The wrist guide wherein the channel receives the grommet.

A training aid comprises a wrist guide having a first wrist portion, a second wrist portion and a connecting portion extending between the first wrist portion and said second wrist portion, the second wrist portion receiving a visual aid in one of a first orientation and a second orientation, the first orientation being substantially vertical and the second orientation being horizontal, the visual aid being movable in the second orientation between a first position and a second position. The training aid wherein the connecting portion is U-shaped between the first wrist portion and the second wrist portion. The training aid wherein the first wrist portion extending generally linearly. The training aid wherein the first wrist portion is curved. The training aid wherein movement from the first position to the second position is pivotal movement.

BRIEF DESCRIPTION OF THE ILLUSTRATIONS

Embodiments of the invention are illustrated in the following illustrations.

DETAILED DESCRIPTION

Figure 1:
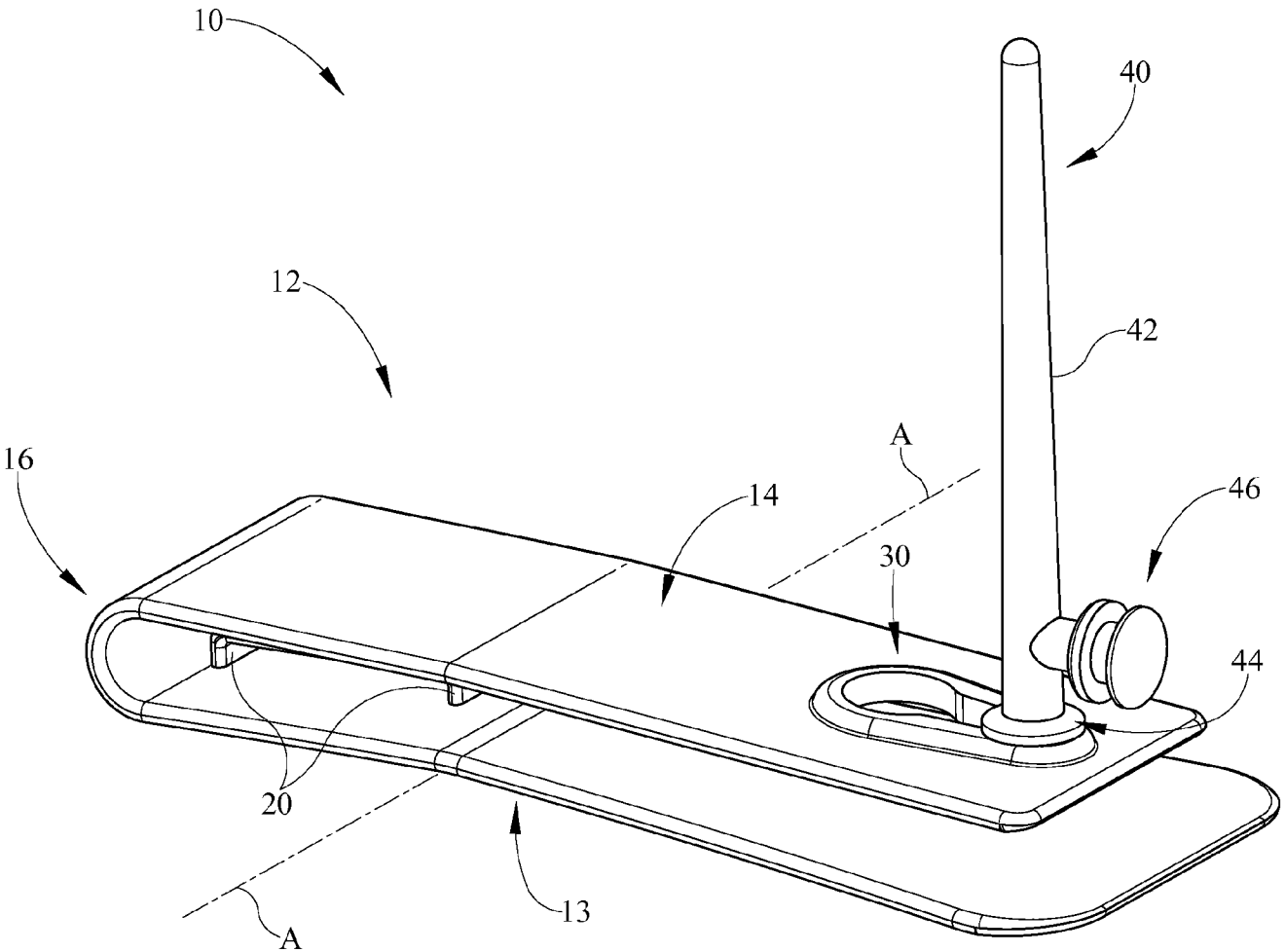
FIG. 1 is a perspective view of an exemplary training aid.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

A training aid is shown in the various FIGS. 1-10. The exemplary training aid utilizes means for connecting the training aid to a user's hand and further comprises a visual aid which may be oriented in at least either of first and second positions. In at least one of these orientations, the visual aid may be disposed in various positions to provide visual indications to the user during training activities, such as for golf.

Figure 6:
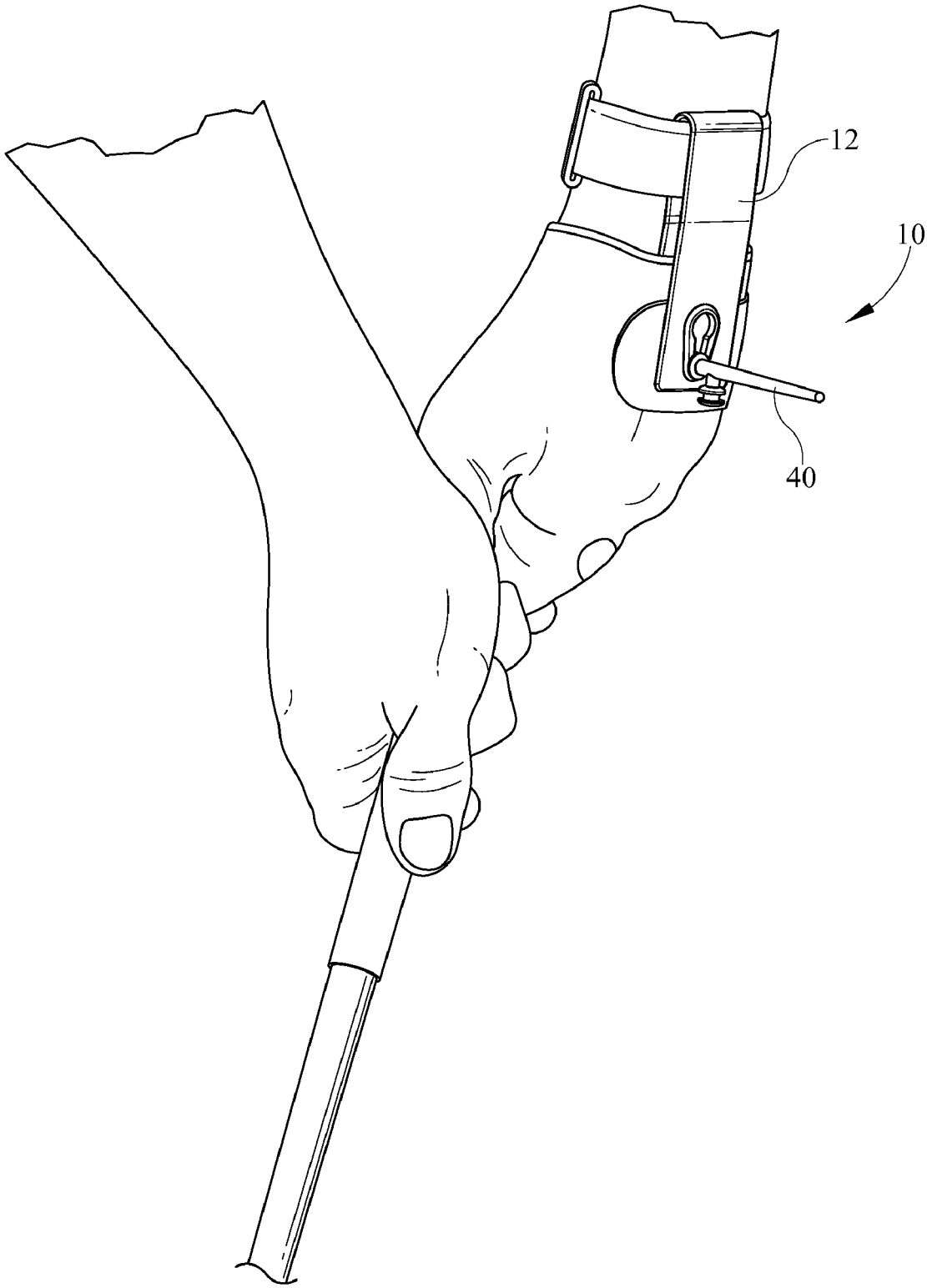
FIG. 6 is a second perspective view of the exemplary training aid in use in a second user position.

Referring now to FIG. 1, a perspective view of the wrist guide training aid 10 is depicted in perspective view having a wrist guide 12 and visual aid 40. The wrist guide 12 includes a first portion 13, a second portion 14 and a connecting segment 16 extending between the first and second wrist guide portions 13, 14. The wrist guide 10 is generally U-shaped and the first and second wrist guide portions 13, 14 may be straight or have a slight bow which is convex about an axis A which is parallel to the curvature axis of the connecting segment 16. This bow may place the user's wrist at a proper angle for impact with a golf ball during use of the training aid 10. The angle of the at least first structure 13 and/or second structure 14 relative to the connecting segment 16 may be at least about 160-195 degrees. The training aid 10 is generally U-shaped, as previously mentioned, so that the first wrist guide portion 13 is positioned against a user's dorsal hand surface and beneath a golf glove worn on the same hand. The second wrist guide portion 14 is positioned on an upper surface of a glove and the Velcro strap of the glove may be positioned over the portion 14 or through the opening defined between the first wrist guide portion 13 and the second wrist guide portion 14 as shown in FIG. 6. The first and second guide portions 13, 14 and the connecting segment 16 may be formed of various elastomerics, polymerics or plastomeric material and may be a molded article which has some flexibility so as to be used with hands of various size and shapes and not to break. Alternatively, lightweight metallics may be utilized.

Along an interior side of one of the first and second wrist guide portion 13, 14 is at least one friction rib 20. The at least one rib 20 defines an area wherein a wrist strap 15 (FIG. 6) may be located. The friction ribs 20 grasp the user's golf glove in order to retain the wrist strap 15 in position on the user's arm and hand during use. As shown, two ribs 20 are used to capture the strap 15.

The training aid 10 also includes a visual aid 40. The visual aid 40 is connected to the training aid 10 at a receiver 30. The visual aid 40 includes a pin structure 42 and first and second buttons 44, 46. The pin 42 is tapered or may be untapered and may have various cross-sections such as circular, triangular or square. These are not limiting though as various shapes may be used. In the depicted embodiment, the receiver 30 is generally a female part and the buttons 44, 46 are male. In an exemplary embodiment, the female part may be located on the visual aid 40 and the male part 30 may be positioned on the wrist guide 12. The buttons 44, 46 allow for orienting of the pin 42 in either a first, vertical orientation shown in solid line or a second, horizontal orientation shown in broken line. The term button is used to represent any retaining mechanism. The visual aid 40 is shown in a first orientation extending generally perpendicular to the outer surface of the second wrist guide structure 14. Alternatively, the visual aid 40 may be positioned so that the pin 42 is generally parallel to the wrist guide portion 14 as discussed further herein. Finally, the visual aid 40 may be formed of various materials as cited for the wrist guide 12. Additionally, alternate materials may be utilized which allow bending of the visual aid to preselected positions other than those shown so that the pin 42 may be disposed at various angles relative to the wrist guide 12.

Figure 2:
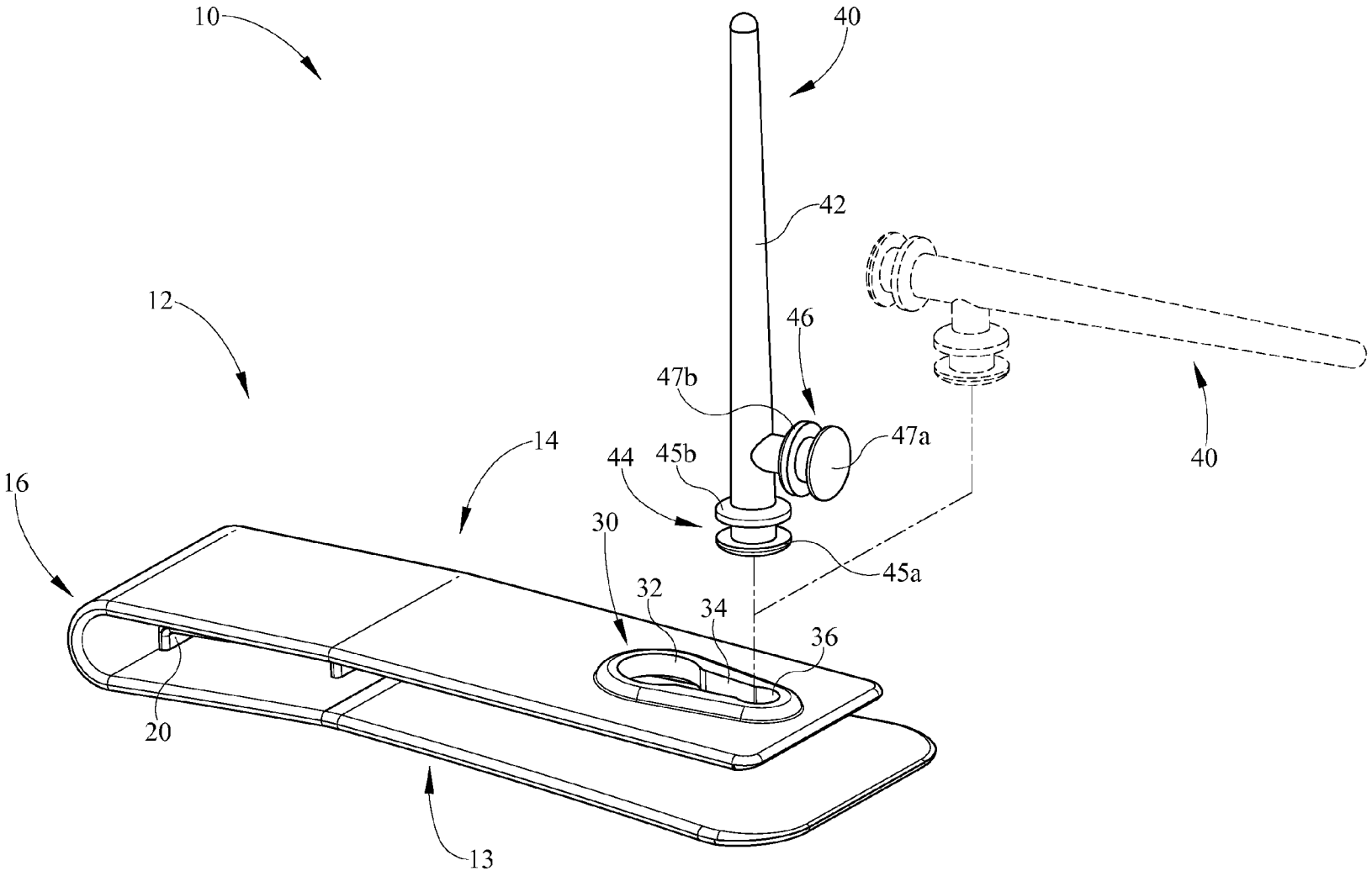
FIG. 2 is an exploded perspective view of the exemplary training aid of FIG. 1 with a visual aid in first and second orientations.

Referring now to FIG. 2, the training aid 10 is depicted with the visual aid 40 exploded from the second wrist guide portion 14. The visual aid 40 is shown in solid line in a vertical position as depicted in FIG. 1. As an alternative, the second position of the visual aid 40 is shown in broken line, so as to understand the second orientation which is capable with the visual aid 40. The visual aid 40 is received in the receiver or receiving aperture 30. The aperture has a first portion 32 having a first radius, a second portion 36 having a second radius which is less than the radius of the first portion 32 and a connector region 34 extending between the first and second radii 32, 36. Since the buttons 44 and 46 are round, the first and second radii 32, 36 are used. However, alternate corresponding shapes may be used for the buttons 44, 46 and portions 32, 36. In operation, the visual aids 40 are positioned in the first portion 32 and may be slid to the second portion 36 which effectively locks the visual aid 40 in the receiver 30. To remove the visual aid, the structure is moved from the second portion 36 to the first portion 32 for removal from the receiver 30.

At a lower end of the pin 42 is the button 44 which is generally defined by first and second rings 45*a*, 45*b* extending from the outer surface of the pin 42. These rings 45*a*, 45*b* are moved within the first portion 32 of receiver 30 so that when the visual aid 40 is moved into the second portion 36, the upper ring 45*b* is disposed above the upper receiver surface and the lower ring 45*a* of button 44 is positioned beneath the receiver 30 and along the lower or inside surface of second wrist guide portion 14. The second button 46 is utilized when the visual aid 40 is positioned generally parallel to the second wrist guide portion 14. In this orientation swing plane may be checked as well as other visual aid capabilities. The button 46 also is comprised of an upper ring 47*b* and a lower ring 47*a* which generally capture the receiver 30, and more specifically the second portion 36 between the rings.

Figure 3:
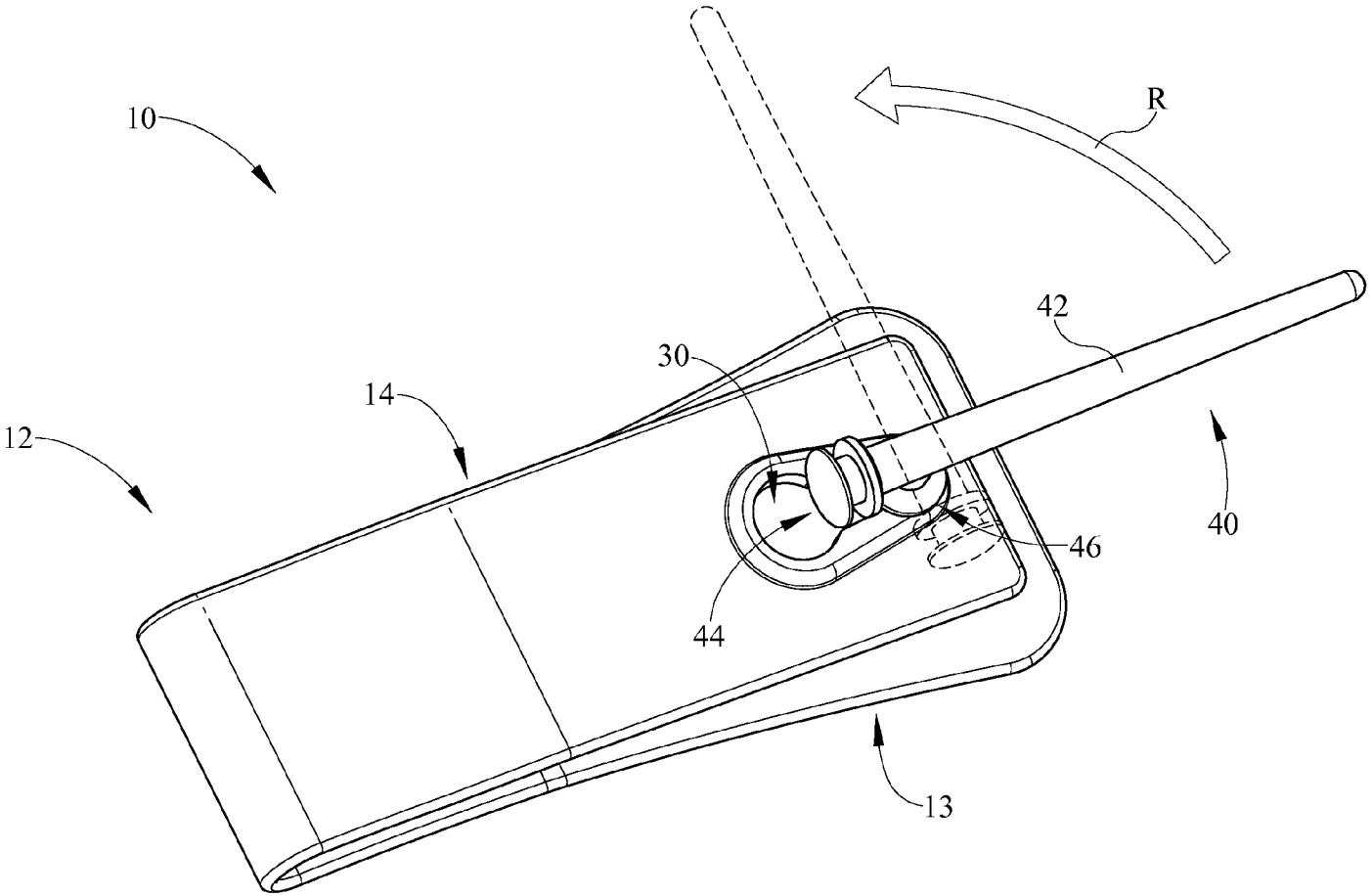
FIG. 3 is an upper perspective view of the exemplary training aid with the visual aid in the first orientation.

Referring now to FIG. 3, an upper perspective view of the training aid 10 is depicted with the visual aid 40 in a second orientation. As shown by the arrow R, the visual aid 40 may be rotated through various positions in order to cause the visual aid 40 to point at a desired location as a point of reference or check during golf training. In practice, the visual aid 40 may be moved through an arc of about 360 degrees to any preselected position. This allows the golfer to stop a practice swing and determine if the user's hand is in a correct position and orientation by examining the location of the visual aid 40. More specifically, the user can review a location where the visual aid 40 is pointing when the golf swing is stopped.

As also seen from the view of FIG. 3, the lower portion 13 of wrist guide 12 has a larger surface area than the upper portion 14. This adds stability through contacting surface area for the wrist structure 12. The increased surface area is provided by simply tapering the side edges of the first structure 13. However, alternate shapes may be utilized.

Figure 4:
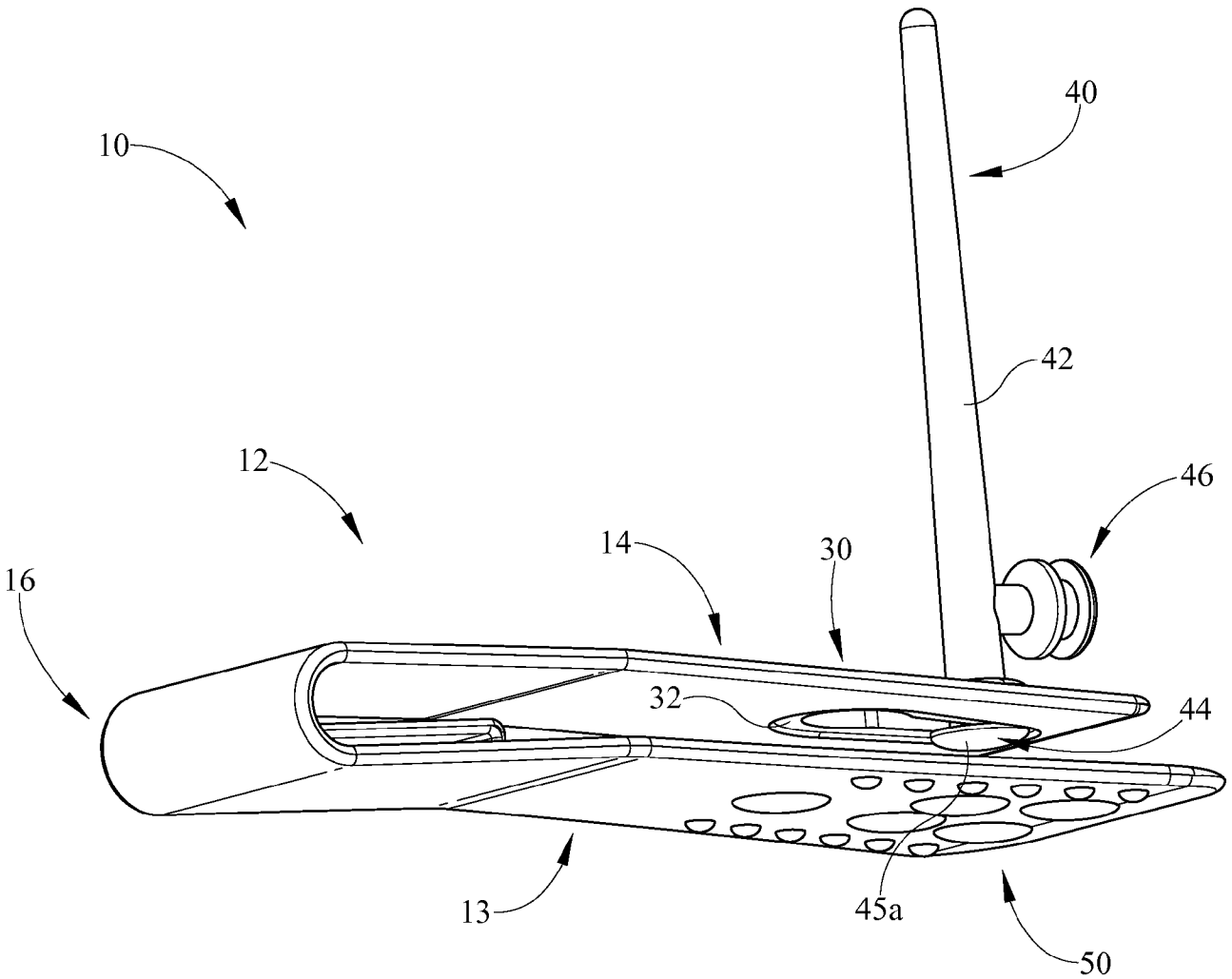
FIG. 4 is a lower perspective view of the exemplary training aid revealing the lower surface of the training aid.

Referring now to FIG. 4, a perspective view of the training aid 10 is depicted such that the outer or lower surface of the first wrist guide structure 12 is shown. Along the lower surface of the structure 12 are a plurality of dimples 50. These dimples 50 allow air to pass between the training aid 10 and the user's hand so that the training aid does not stick to the dorsal surface of the user's hand. Additionally, the dimples 50 act as a grip mechanism to inhibit sliding of the device during usage. The dimples 50 are generally circular in shape however various shapes may be utilized for these protuberances.

Also, the Figure depicts the under or inner surface of wrist guide 12. In this view, the button 44 has been positioned in aperture 32 and moved to second aperture area 36. In this position, lower ring 45*a* is positioned along lower surface of receiver 30 and upper ring 45*b* is along an upper surface. Effectively, the button 44 is captured vertically and frictionally captured horizontally so as to be retained in the second aperture area 36.

Figure 5:
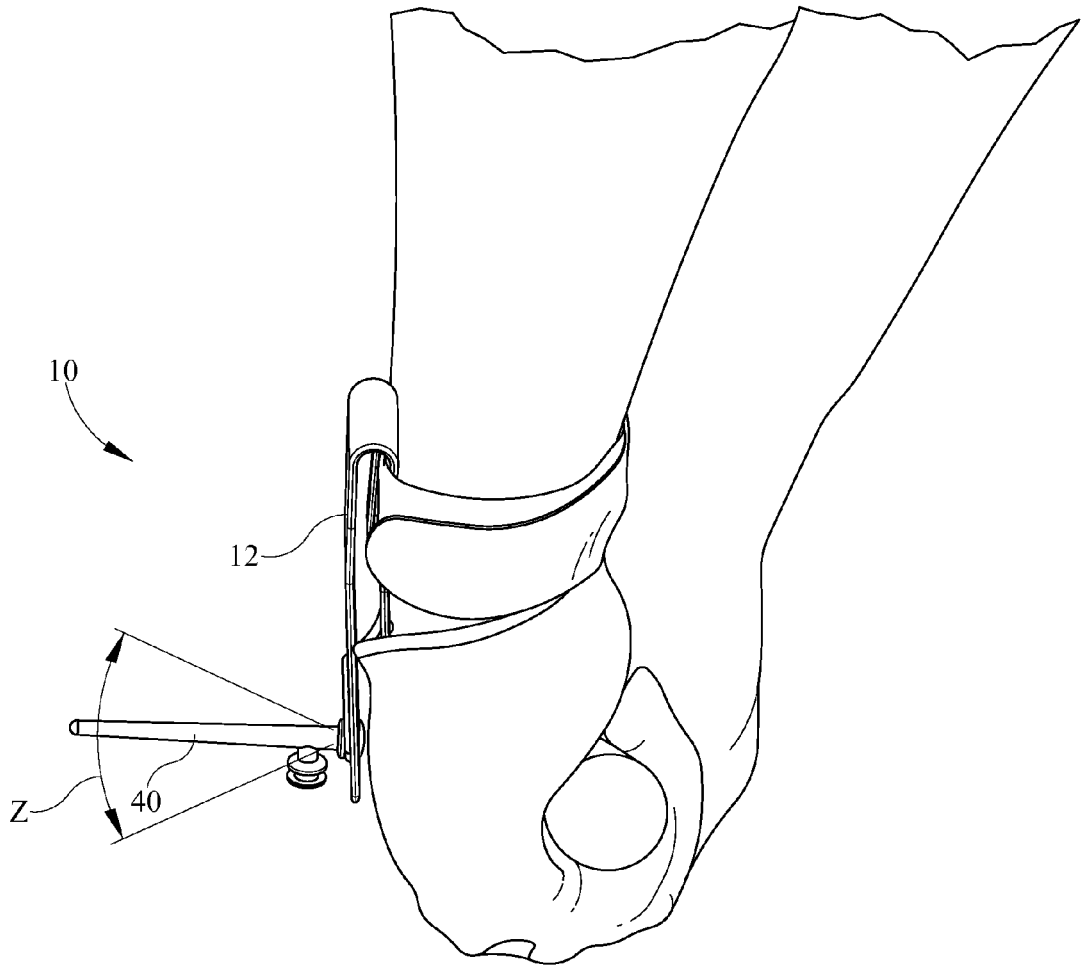
FIG. 5 is a perspective view of the exemplary training aid in use.

Referring now to FIG. 5, a side view of a user having the training aid 10 is depicted during a takeaway portion of the golf swing. In this position, the user's hands are partially taken away from the set up position and the golf club is generally parallel to the ground below (not shown). When the club is generally parallel to the ground, the pin 40 is generally positioned extending from the training aid in a position which is perpendicular to the golf club and also parallel to the ground. The Figure depicts an angle or zone Z wherein the pin 40 may be located during the club takeaway when the club is generally parallel to the ground which is acceptable for the dorsal hand surface to be positioned without causing tremendous swing deficiencies.

Referring now to FIG. 6, the hands of the golfer are shown in a position associated with the downswing just prior to or at impact with the golf ball. The left hand having the training aid 10 is depicted and the pin 40 is extending toward a target. Thus, the angle of the pin is downward to dictate ball flight and trajectory. The pin 40 is also extending along the target line. Thus with practice, the pin 40 will point to a specific object or along a line and indicate whether a user has the left hand in a correct position for impacting a golf ball. The hand position depicted in FIG. 6 ensures downward striking contact on the ball necessary for improved compression and trajectory control.

Figure 7:
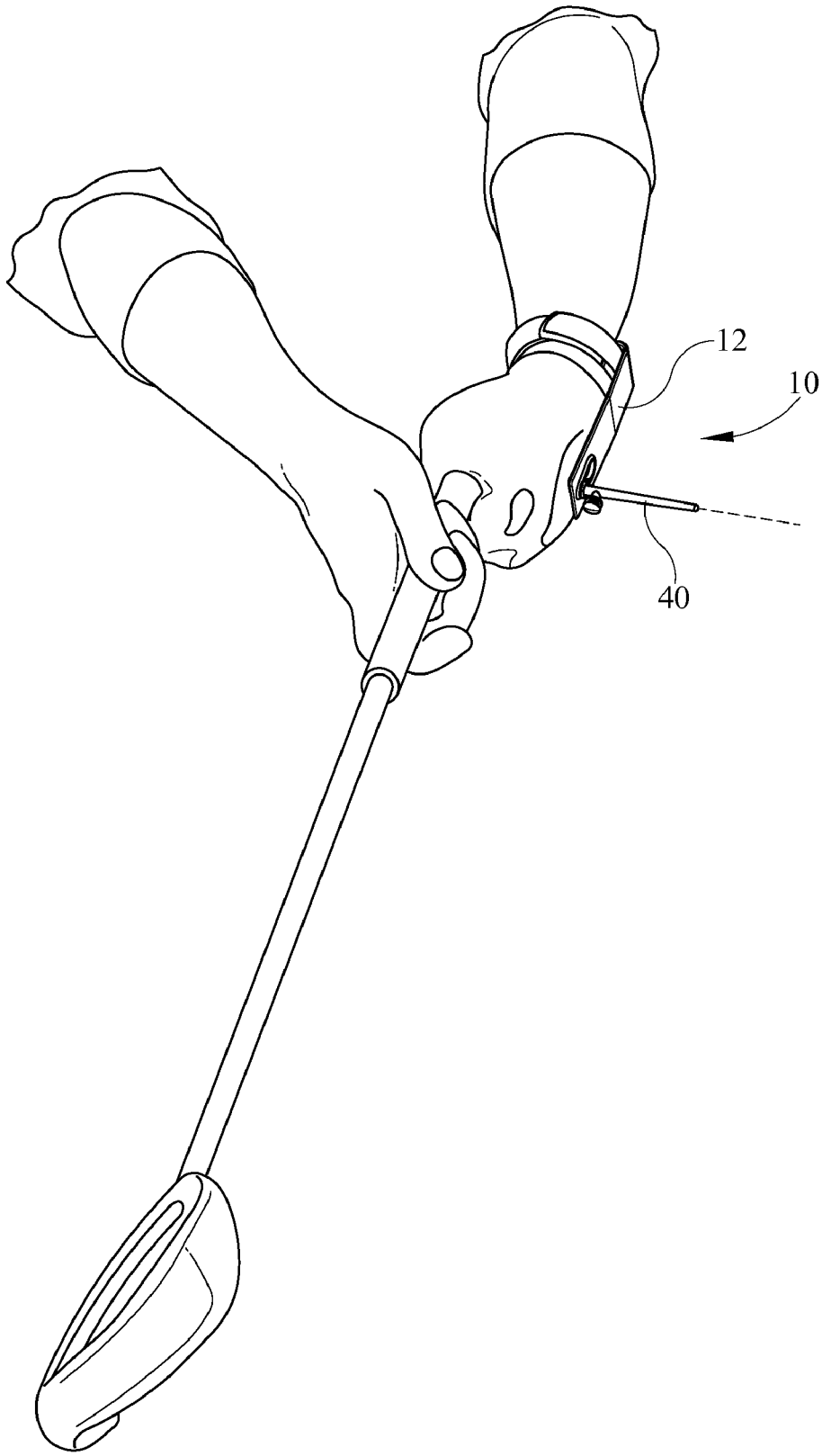
FIG. 7 shows a position of the training aid just following impact with the golf ball to draw the golf ball.

Referring now to FIG. 7, a view of the golf club and training aid 10 is depicted immediately following impact. The training aid 10 aids in teaching a user to either draw or fade a golf ball. A draw is a shot having spin such that the ball curves from right to left, for a right-handed golfer. In the Figure depicted, the club face is closed (exaggerated) as provided by the rotation of the right and left hands. The training aid 10, more specifically the pin 40, is pointing downwardly along or left of a target line. The amount of rotation of the left hand and the right hand will control the amount of spin on the ball, and thus the amount of curvature of the draw. Thus by selecting a target to aim the visual aid 40, the user will learn by practice if rotation of the hands is proper for a shot, for example a draw.

Figure 8:
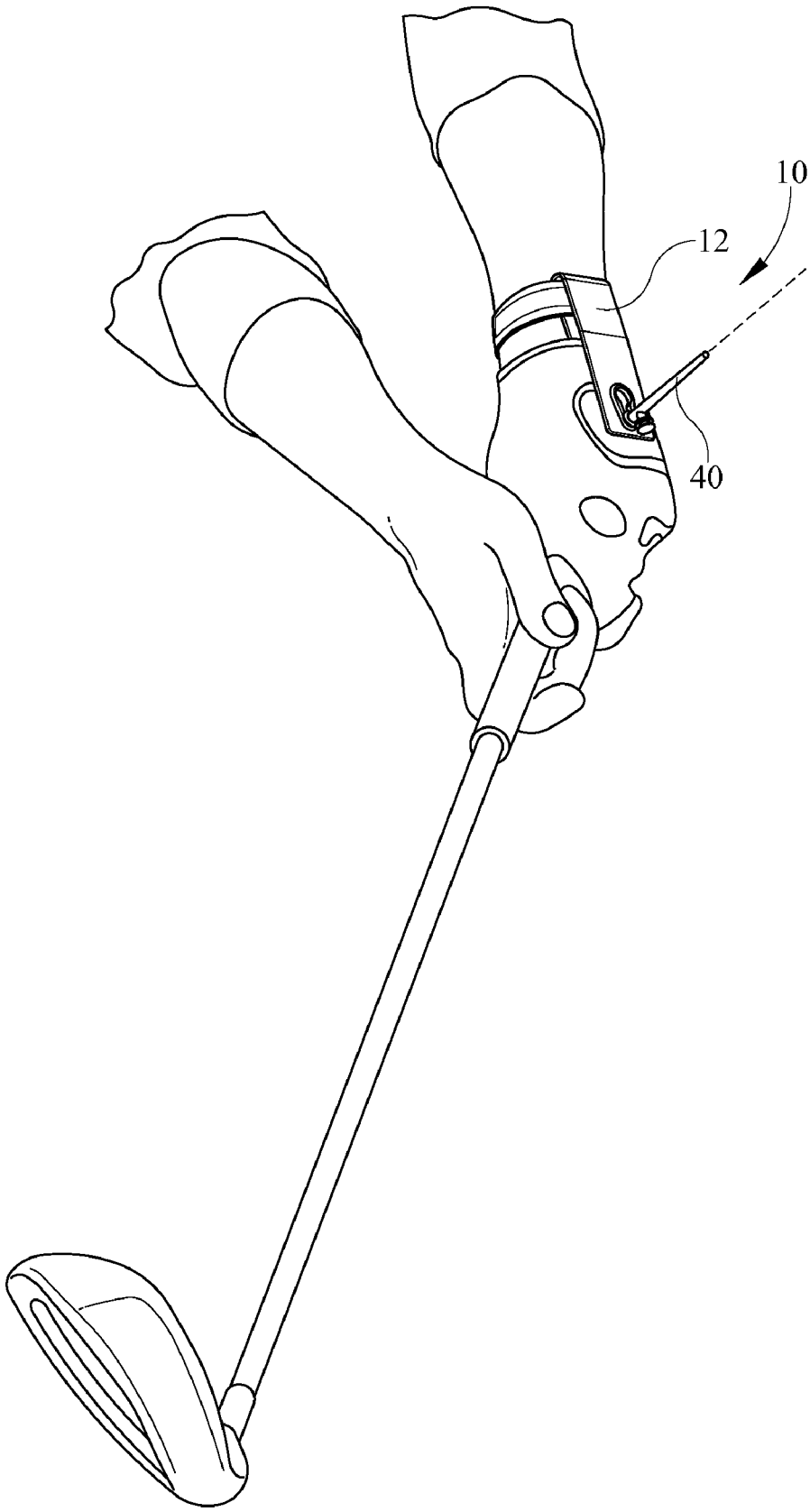
FIG. 8 shows a position of the training aid just following impact with the golf ball to fade the golf ball.

By contrast, and as shown in FIG. 8, the hand position is shown and results in an open clubface. The fade position of the hands through impact causes the ball to spin and curve from left to right, by a right-handed golfer. In the fade position depicted, the dorsal surface of the left hand does not rotate over and point downward as with the draw, but instead is held so that the dorsal surface of the hand points slightly upward. This is visually indicated by the visual aid 40 which is pointing upward rather than downward in FIG. 7. As a result, a user can select a target to aim the visual aid 40 so that through practice, the user can learn to position the hands through impact for hitting a fade.

Figure 9:
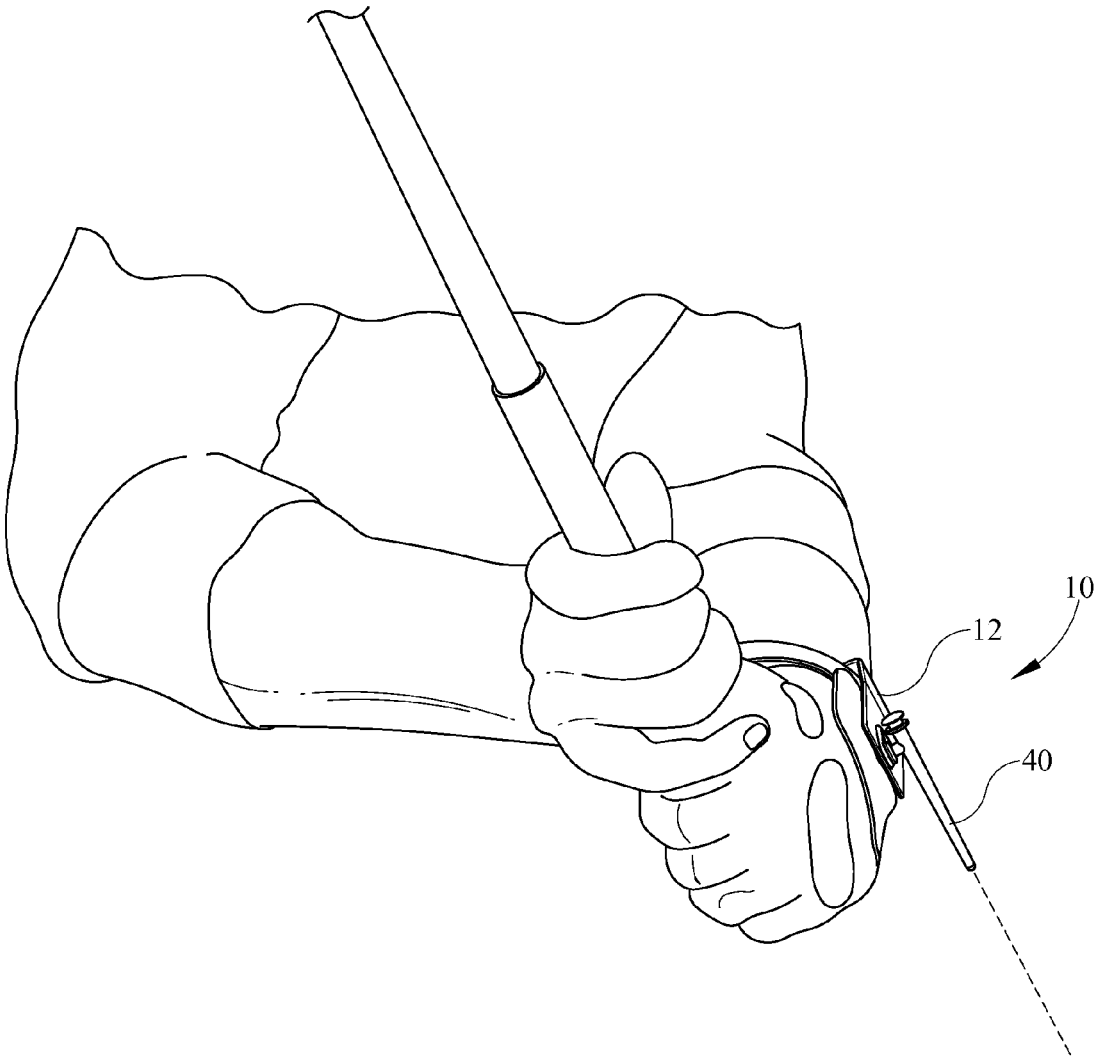
FIG. 9 shows a second orientation of the visual aid and use during a practice swing; and, FIG. 10 shows an alternate visual aid having a laser pointer embodiment.

Referring now to FIG. 9, the visual aid 40 is shown in its second orientation which is generally parallel to the dorsal surface of the hand rather than perpendicular thereto. In this parallel position, the visual aid 40 may be rotated in multiple positions to point at various objects throughout the backswing and/or downswing and check position of the hand easily related to the golf swing. The visual aid 40 is shown in a parallel position to the dorsal surface of the hand and generally parallel to the golf club shaft. The line extending from the visual aid 40 is pointing to the golf ball or just inside the golf ball. These visual references relative to objects around the golfer further aid in determining whether a golf club is in proper positions at different stages of the swing.

Figure 10:
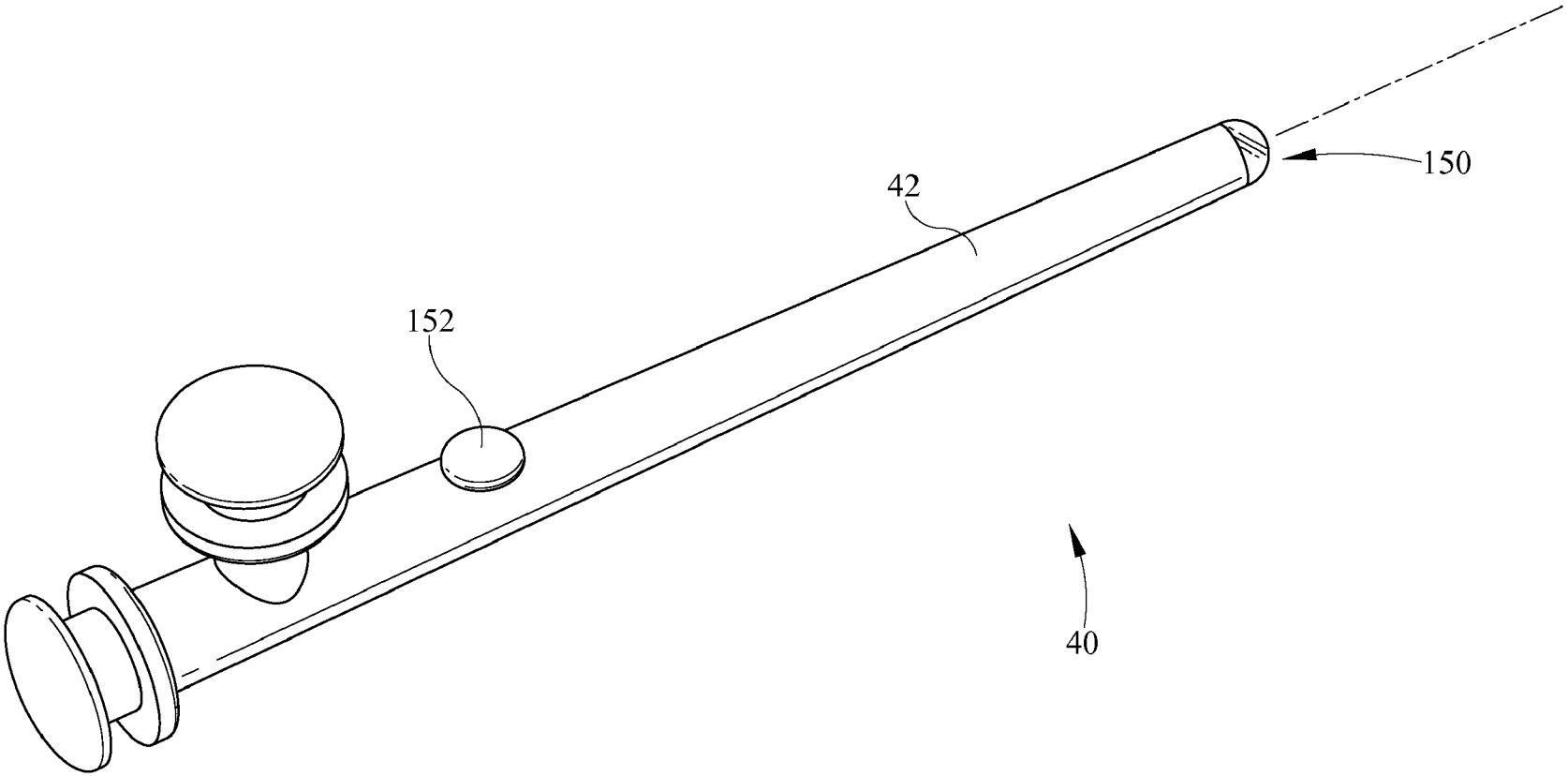

Referring now to FIG. 10, a perspective view of an alternative visual aid 140 is depicted. The visual aid 140 includes a laser 150 which is emitted from the small end of the visual aid. The laser 150 includes a button 152 to turn on or off the laser. The laser 150 points to the specific objects so as to more easily determine if the golf club and the left hand of the golfer are in proper plane positions as discussed previously. This is termed as active visual indication as opposed to the visual aid 40 which is passive and does not have any action or emission apart from the visual positioning of the aid 40 itself.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A wrist guide for athletic training, comprising:

a first wrist structure extending along a user's wrist, said first wrist structure having a first end and a second end, said first wrist structure having an inner surface and an outer surface;

a curved element having a first end connected to said first wrist structure and a second end connected to a second wrist structure;

said second wrist structure extending from said curved element above said first wrist structure;

a visual aid receiver on an upper surface of said second wrist structure, said receiver having a first portion for receiving a visual aid and a second portion in communication with said first portion for movement of the visual aid;

said visual aid positioned in said receiver and being positionable in a first orientation wherein said visual aid is substantially perpendicular to an outer surface of said second wrist structure and a second orientation wherein said visual aid is substantially parallel to said outer surface of said second wrist structure.

2. The wrist guide of claim 1, said first wrist structure being parallel to said second wrist structure.

3. The wrist guide of claim 1, said wrist guide being substantially U-shaped.

4. The wrist guide of claim 1 wherein said visual aid is slidable from a first location to a second location.

5. The wrist guide of claim 1 said receiver having a first position having a first radius and a second position having a second radius.

6. The wrist guide of claim 5 further comprising a lip extending about said receiver at said second position.

7. The wrist guide of claim 1, said visual aid having a first button for orienting said visual aid in said first orientation and a second button for orienting said visual aid in said second orientation.

8. The wrist guide of claim 1 further comprising a plurality of dimples on an outer surface of said first wrist structure.

9. A wrist guide, comprising:

a clip defined by a first wrist guide structure and a second wrist guide structure;

a connecting segment which is curvilinear and extending between said first wrist guide structure and said second wrist guide structure;

said clip being shaped to fit between a user's hand and a golf glove;

an outer surface of said clip having a receiver, said receiver having a visual aid therein, said receiver including a first location for removal of said visual aid and a second location for retaining said visual aid;

said visual aid having at least one mating structure which is received by said receiver and movable from said first location to said second location;

said at least one mating structure allowing said visual aid to be positioned in one of a first orientation and a second orientation, said first orientation being one of substantially parallel or substantially perpendicular to said second wrist guide structure.

10. The wrist guide of claim 9, said at least one mating structure being a grommet.

11. The wrist guide of claim 10, said grommet having a channel.

12. The wrist guide of claim 11, a lip extending about a portion of said receiver.

13. The wrist guide of claim 12, said channel receiving said grommet.

14. A training aid, comprising:

a wrist guide having a first wrist portion, a second wrist portion and a connecting portion extending between said first wrist portion and said second wrist portion;

said second wrist portion receiving a visual aid in one of a first orientation and a second orientation, said first orientation extending substantially vertically from said wrist guide and said second orientation extending substantially horizontally from said wrist guide;

said visual aid being movable in said second orientation between a first position and a second position.

15. The training aid of claim 14, said connecting portion being U-shaped between said first wrist portion and said second wrist portion.

16. The training aid of claim 14, said first wrist portion extending generally linearly.

17. The training aid of claim 14, said first wrist portion being curved.

18. The training aid of claim 14 wherein movement from said first position to said second position is pivotal movement.

* * * * *